United States Patent [19]

Groenke et al.

[11] Patent Number: 4,598,298

[45] Date of Patent: Jul. 1, 1986

[54] PLOTTER HAVING AUTOMATIC SHEET FEEDER

[75] Inventors: Jeffery W. Groenke; Wallace S. Halliday, both of San Diego, Calif.

[73] Assignee: Hewlett-Packard Company, Palo Alto, Calif.

[21] Appl. No.: 609,065

[22] Filed: May 9, 1984

[51] Int. Cl.[4] ..... G01D 15/28

[52] U.S. Cl. ..... 346/1.1; 271/239; 271/250; 271/902; 346/129; 346/134

[58] Field of Search ..... 346/134, 129, 1.1; 355/14 SH; 271/239, 250, 902

[56] References Cited

U.S. PATENT DOCUMENTS

| | | | |
|---|---|---|---|
| 3,666,262 | 5/1972 | Fowler | 271/902 X |
| 3,761,950 | 9/1973 | Yeiser | 346/134 X |
| 4,216,482 | 8/1980 | Mason | 346/134 X |
| 4,384,298 | 5/1983 | LaBarre | 346/134 X |
| 4,463,361 | 7/1984 | Koumura | 346/134 |

*Primary Examiner*—Joseph W. Hartary

*Attorney, Agent, or Firm*—Douglas A. Kundrat; Patrick J. Barrett

[57] ABSTRACT

A high accuracy pen plotter includes an automatic sheet feeder for feeding individual sheets of paper from a paper tray to a platen for plotting. A microprocessor, various stepper motors and encoders allow for accurate and repeatable positioning and alignment of the sheet of paper to be plotted. The sheet of paper is automatically fed from the tray to the platen, is pulled entirely free from the tray, is aligned against a reference edge and may be forcefully ejected from the plotter after plotting is finished.

6 Claims, 17 Drawing Figures

PLOTTER HAVING AUTOMATIC SHEET FEEDER

BACKGROUND AND SUMMARY OF THE INVENTION

With the advent of low-cost microprocessors, high speed and high resolution pen plotters have become increasingly sophisticated. Most plotters, such as the Hewlett-Packard Co. model 7470A plotter, require that the operator manually load and orient each sheet of paper prior to plotting. This requirement drastically decreases plotter throughput and also increases plotting costs because of the need for operator supervision. A number of plotters, such as the Hewlett-Packard Co. model 7586B plotter, allow roll feeding using a continuous paper roll from which individual sheets are cut to size after plotting is completed. Although roll feeding increases speed and reduces cost, it requires the use of special roll paper which is often disadvantageous in addition to being costly.

In accordance with the illustrated preferred embodiment of the present invention, a microprocessor controlled plotter incorporates an automatic sheet feeder which provides feeding and alignment of individual sheets of paper. The plotter is capable of high speed plotting without operator supervision and allows for the use of low cost and commonly available sheet paper. By the use of stepper motors and linear and angle encoders, paper motion can be monitored with a high degree of accuracy and highly accurate positioning and alignment of the paper can be obtained. Although commonly available photocopiers use various techniques for sheet feeding of copier paper, none of the photocopiers achieves, or requires, the high degree of positioning and alignment accuracy that is achieved by the present invention.

Paper is received from a paper tray by the use of the forward buckling feed technique which is commonly used in low cost photocopiers such as the Canon, Inc., model PC-20 copier. In this pre-feed step, the paper is fed through a deflection door and the leading edge is set between a pair of grit wheels and a pair of pinch rollers. A pen carriage includes a probe which is used to detect paper presence at the platen and which is also used to open and close the deflection door. Once a pre-feed step is successfully completed and paper is detected at the platen, the door is lightly closed and the grit wheels pull the sheet of paper onto the platen until the trailing edge is detected. The paper edge is aligned with an edge perpendicular to pen carriage motion by releasing one grit wheel and forward and reverse feeding the paper a number of times. Rotational forces about the fixed grit wheel cause the paper edge to firmly align against the perpendicular edge.

With the use of high accuracy stepper motors and encoders, the length and width of the aligned paper is determined to a high degree of accuracy and this information may be used by the microprocessor to control subsequent plotting. When plotting is completed, the grit wheels are used to eject the sheet of paper and a new sheet may be fed and aligned on the platen.

DETAILED DESCRIPTION OF THE PREFERRED EMBODIMENT

Figure 1:
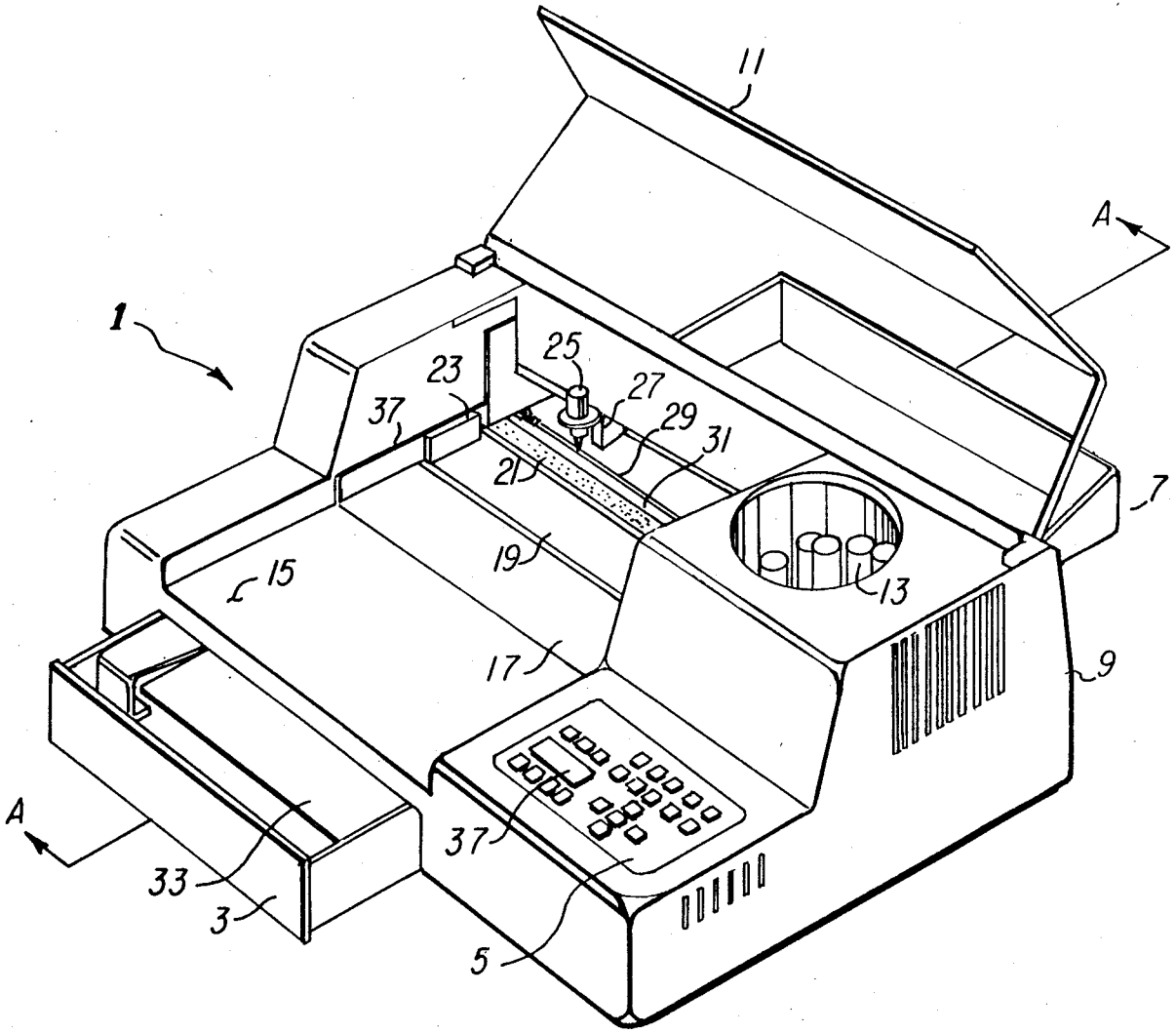
FIG. 1 shows a plotter which is constructed in accordance with the preferred embodiment of the present invention.

FIG. 1 shows a plotter 1 which is constructed in accordance with the illustrated preferred embodiment of the present invention. A paper tray 3, similar to those used in low cost photocopiers such as the Canon, Inc., model PC-20, allows for the use of both metric and English size paper 33. A keyboard 5 allows the user to input specific commands to the plotter 1 and a display 37 allows certain responses to be given to the user. Control of the plotter 1 may also be performed by use of an independent computer. A receiving tray 7 is used to catch completed plots on sheets of paper. A housing 9 and a clear cover 11 protect the mechanisms of the plotter 1. A pen carousel 13, similar to those used in, .e.g., the Hewlett-Packard Co. model 7580B plotter, allows for the use of eight different pens 25 during plotting. Beds 15 and 17 support the paper during sheet feeding, alignment and plotting. Deflection door 19 also serves to support the paper and allows for feeding of the paper from the paper tray 3.

Platen 21 supports the paper during plotting by pen 25 over a writing surface 31 portion of the platen 21. Platen 21 may include air holes which allow a vacuum to be applied to the paper to firmly hold the paper in place during plotting. All of the flat surfaces which contact the paper may be fabricated from plastic, but it is preferable to use a plastic compound which includes carbon so as to be electrically conductive. In this way, the flat surfaces may be grounded and increased friction due to static electricity may be avoided. A perpendicular edge 37, orthogonal to the travel of pen 25, allows for accurate alignment of the paper before plotting. A small gap exists between door 19 and a hold-down 23 to force paper fed through the gap into close proximity with the platen 21. A pen carriage 27 moves the pen 25 as directed by the microprocessor and also permits paper detection and measurement as is hereinbelow discussed.

Figure 2:
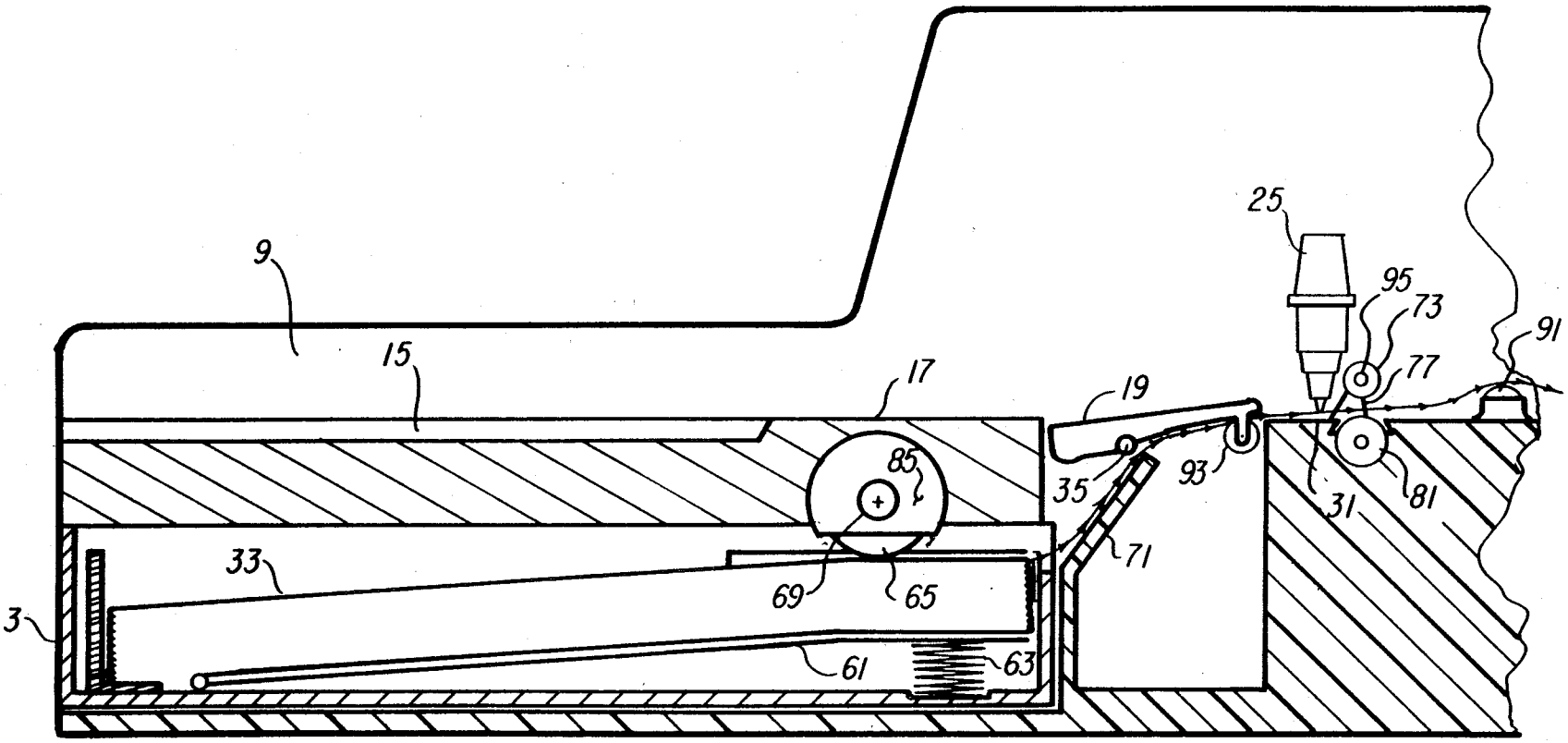
FIG. 2 shows a cut-away view, along line A—A, of the plotter shown in FIG. 1.
Figure 3:
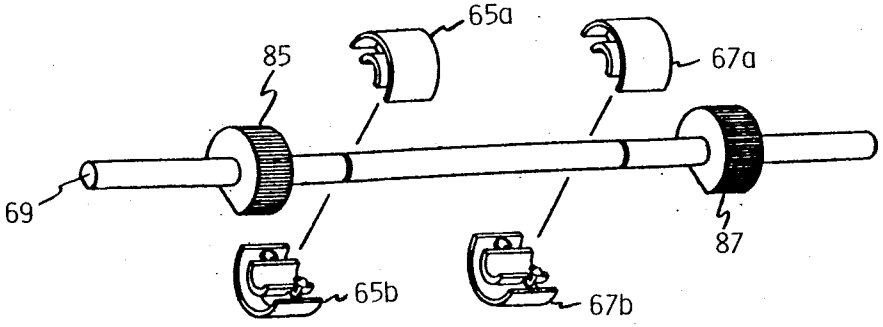
FIG. 3 shows a detail view of a component of the plotter shown in FIG. 1.

FIG. 2 shows a cut-away schematic view of plotter 1 along lines A—A in FIG. 1. The feed path of a sheet of paper 33 is shown by an arrowed line. The paper 33 is loaded against a free idler wheel idler 65 by a spring 63 and a base 61 at the insertion of paper tray 3. A serrated rubber drive wheel 85, mounted on a common drive shaft 69, is flatted to avoid contact with paper 33 until desired. The details of idlers 65, 67 and drive wheels 85 and 87 may be seen in FIG. 3. When feeding of a sheet of paper 33 is desired, shaft 69 is rotated two times which causes the top sheet of paper 33 to be driven along the paper path. This pre-feed step utilizes the well-known forward-buckling technique of paper loading. The rounded distance along the surface of wheel 85 is chosen so that two revolutions position the leading edge of the sheet of paper between pinch roller 73 and grit wheel 81.

Figure 5:
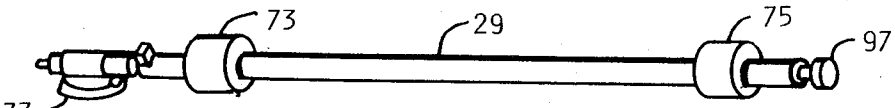
FIG. 5 shows a detail view of a component of the plotter shown in FIG. 1.
Figure 8:
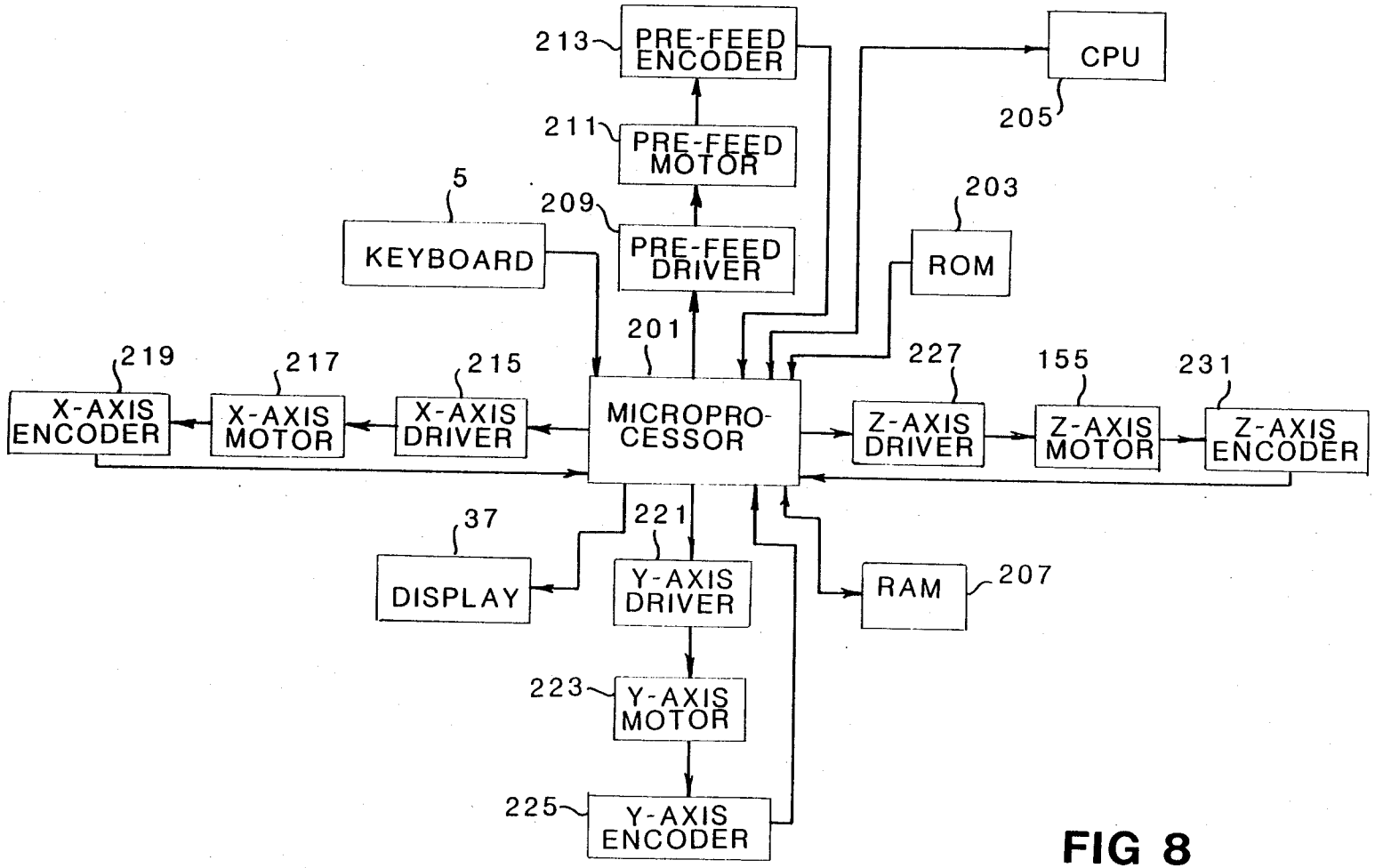
FIG. 8 is a block diagram of the plotter shown in FIG. 1.

With the use of a stepper motor 211 and a shaft angle encoder 213 under control of a microprocessor 201, as shown in FIG. 8, extremely precise control of paper location is achieved since resolution on the order of 0.001 inch is achievable using readily available devices. The sheet of paper 33 is deflected by wall 71 and fits under deflection door 19 which is hinged at pin 35 and is opened as is discussed below. Rollers 91 and 93 allow for smooth motion of the paper 33 between writing surface 31 and pen 25. Pinch roller 73, on pinch roller shaft 95, is lifted away from grit wheel 81 by the use of a cam 77 as is discussed below to allow easy passage of the paper 33. A detailed view of shaft 29, pinch rollers 73, 75, right cam 97 and left cam 77 is shown in FIG. 5. It should be noted that cam 77 is a two-step, helical cam which allows for staged rotational motion of shaft 29.

Figure 6:
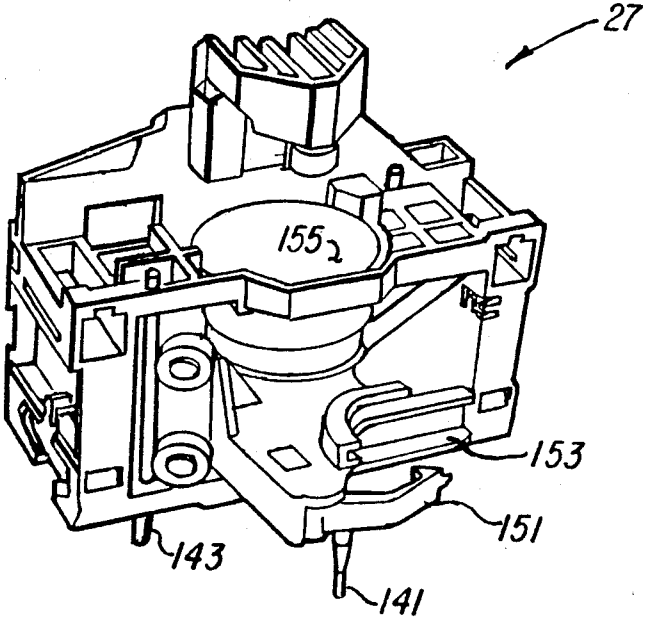
FIG. 6 shows a detail view of the pen carriage used in the plotter shown in FIG. 1.
Figure 4:
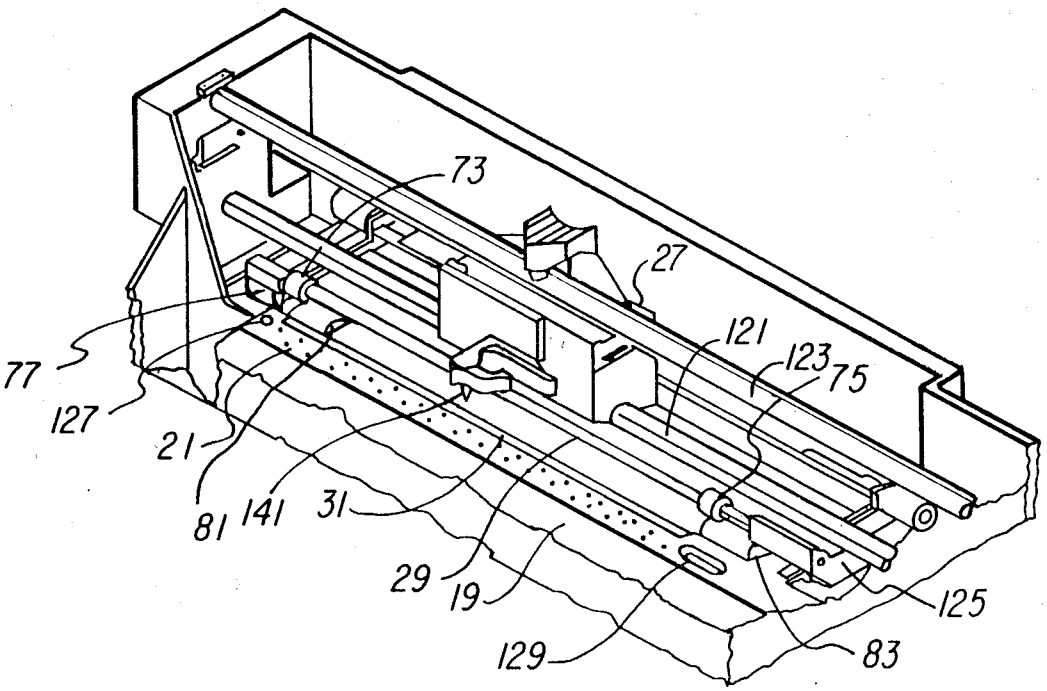
FIG. 4 shows a detailed view of a portion of the plotter shown in FIG. 1.

FIG. 4 shows a detailed view of the region of plotter 1 adjacent to, and posterior to, the pen carriage 27 with the pen 25 removed for clarity. Carriage 27, riding on support shafts 121 and 123, traverses left and right (Y-axis) under the control of the microprocessor 201 using driver 221, stepper motor 223 and shaft angle encoder 225 shown in FIG. 8. By virtue of the high resolution available using modern devices, high and repeatable accuracy in the placement of the pen carriage 27 and the pen 25 in the Y-axis is possible. The pen carriage 27 is shown in more detail in FIG. 6 and includes a backing 153 and a clamp 151 for firmly holding the pen 25. Details of the clamping operation of the pen carriage 27 may be found in U.S. patent application Ser. No. 352,405, which was filed by David C. Tribolet and David L. Paulsen on Feb. 25, 1982, and which is incorporated herein by reference. A voice coil 155 is used to move the pen 25 and a probe 141 in the Z-axis under control of the microprocessor 201 as shown in FIG. 8. A linear encoder 231 (not shown in FIG. 4) is also mounted on carriage 27 to monitor motion in the Z-axis. A pin 143, protruding from the base of carriage 27, is operative for slidably engaging helical cam 77 as carriage 27 is moved to the left.

The Y-axis motion of carriage 27 may be seen in FIG. 4. Carriage 27 is moved by motor 223 using a well-known flexible drive belt which is not shown in FIG. 4 for the sake of clarity. If carriage 27 is moved to the right towards pinch roller 75 and grit wheel 83, probe 141 may be positioned over a hole 129 which is located in platen 21. If carriage 27 is moved to the left towards pinch roller 73 and grit wheel 81, probe 141 may be positioned over a left hole 127. If carriage 27 is moved further to the left, pin 143 contacts the first step of cam 77 and causes the right pinch roller 75 to pivot with arm 125 and to lift above the right grit wheel 83. If carriage 27 is moved further to the left, pin 143 engages the second step of cam 77 and causes the left pinch roller 73 to lift above the left grit wheel 81 so that neither grit wheel is in contact with a pinch roller and the paper 33 may freely pass thereby.

Figure 7:
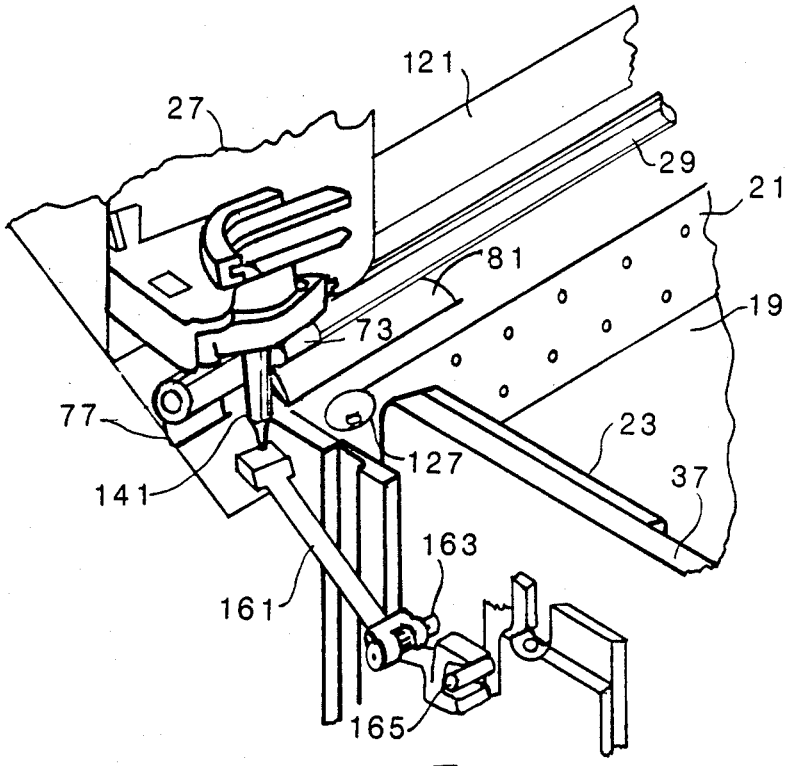
FIG. 7 shows a detail view of a portion of the plotter shown in FIG. 1.

If the carriage 27 is moved as far as possible to the left, as shown in FIG. 7, probe 141 is positioned above a lever 161 as pin 143 remains on the second step of cam 77 so that both pinch rollers remain lifted. If probe 141 is lowered by actuation of motor 155, lever 161 is pivoted about post 163 and stud 165 of door 19 is elevated causing door 19 to open to the position shown in FIG. 2.

Figure 9:
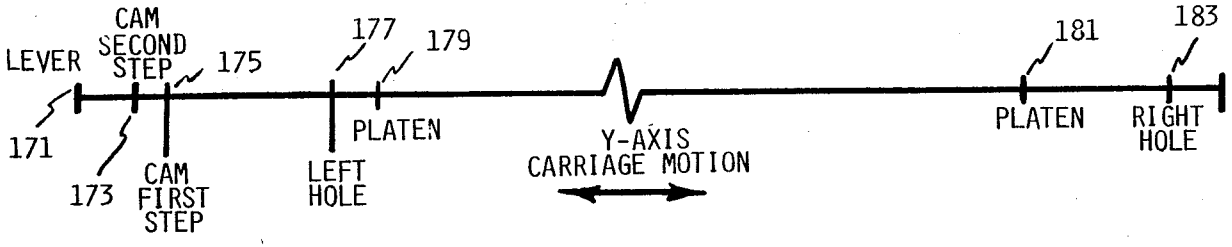
FIG. 9 shows various positions in the Y-axis travel of the pen carriage used in the plotter shown in FIG. 1.

FIG. 9 shows the various positions of carriage 27 as motion in the Y-axis is made. At position 171, probe 141 is in position to cause door 19 to open and pin 143 is engaged with the second step of cam 77. At position 173, pin 143 is still engaged with the second step of cam 77, but probe 141 is not positioned over lever 161. At position 175, pin 143 is engaged with only the first step of cam 77. At position 177, probe 141 is positioned over the left hole 127. At positions 179 and 181, probe 141 is positioned over platen 21. Finally, at position 183, probe 141 is positioned over right hole 129.

Figure 10:
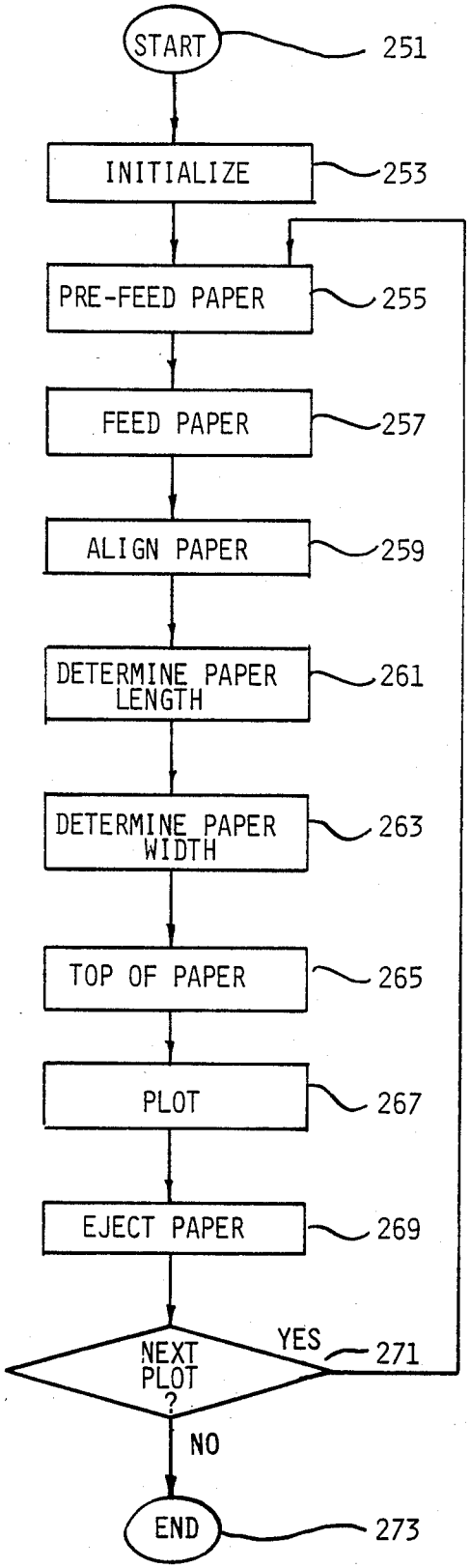
FIG. 10 is a flow chart of the automatic sheet feed and alignment procedures performed by the plotter shown in FIG. 1.
Figure 11:
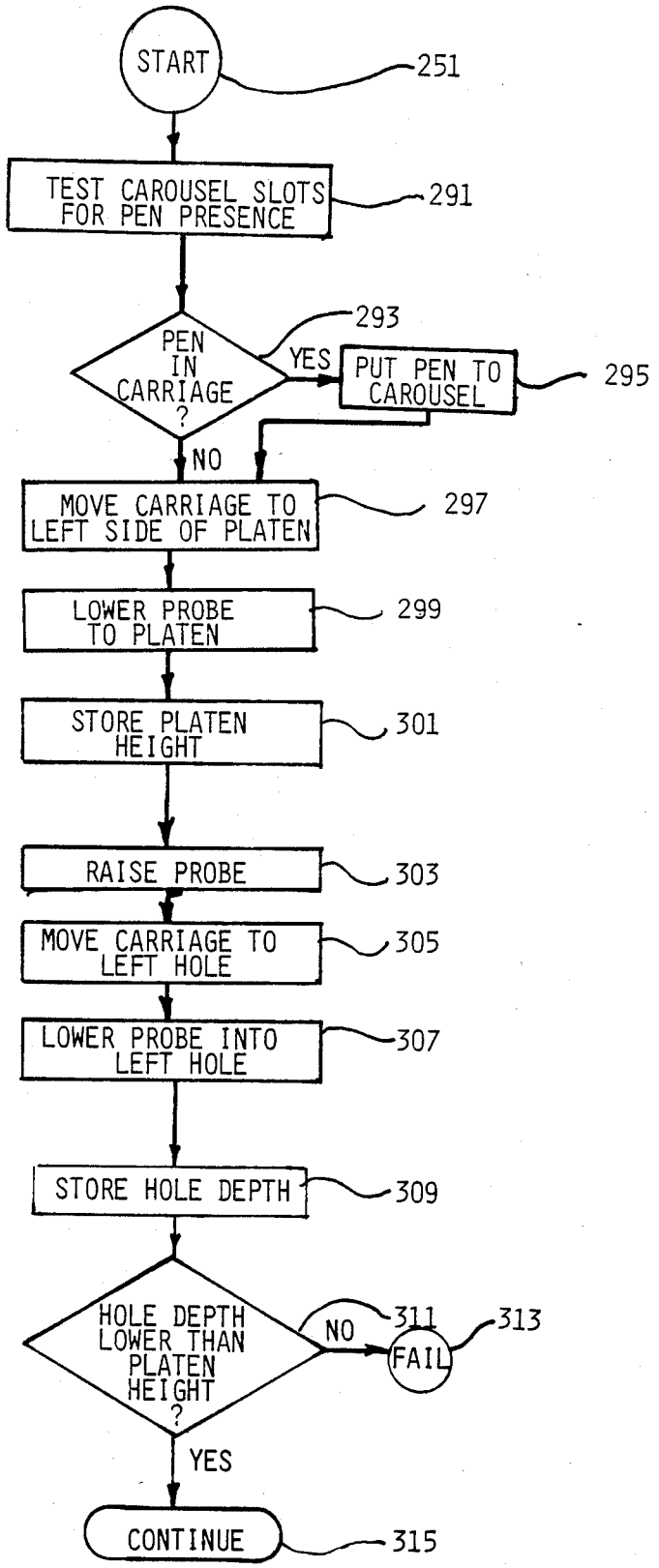
FIGS. 11–17 are detailed flow charts which set out the individual steps performed by the plotter shown in FIG. 1 during performance of the steps shown in the flow chart of FIG. 10.

FIG. 10 is a flow chart of the operations performed by the plotter 1 during the plotting of a sheet of paper 33. Plotting may be made under control of an external computer or CPU 205 and may be aided by the user through keyboard 5. ROM 203 contains many of the routines performed by plotter 1 during plotting. The initialization step 253 is shown in greater detail in the flow chart of FIG. 11. In steps 291–293, an initial test for the location of pen 25 is performed as is described in more detail in the above-referenced Tribolet and Paulsen U.S. patent application. In steps 297 and 299, the carriage 27 is moved to the position 179 and in steps 301, 303, the probe 141 is lowered and the distance to the platen 21 is stored in RAM 207 by recording the motion detected by the linear encoder 231. In steps 305–309, the carriage 27 is moved to position 177 and an attempt is made to lower probe 141 into hole 127. If the probe 141 is able to move lower than the previously measured platen 21 level, then it is assumed that no paper is present on the platen 21. Conversely, if probe 141 is unable to move below the level of platen 21, it is assumed that a sheet of paper is on platen 21 blocking the probe 141 and a failure condition is encountered. At this point, the user may request ejection of the paper or other failure resolution routines may be performed.

Figure 12:
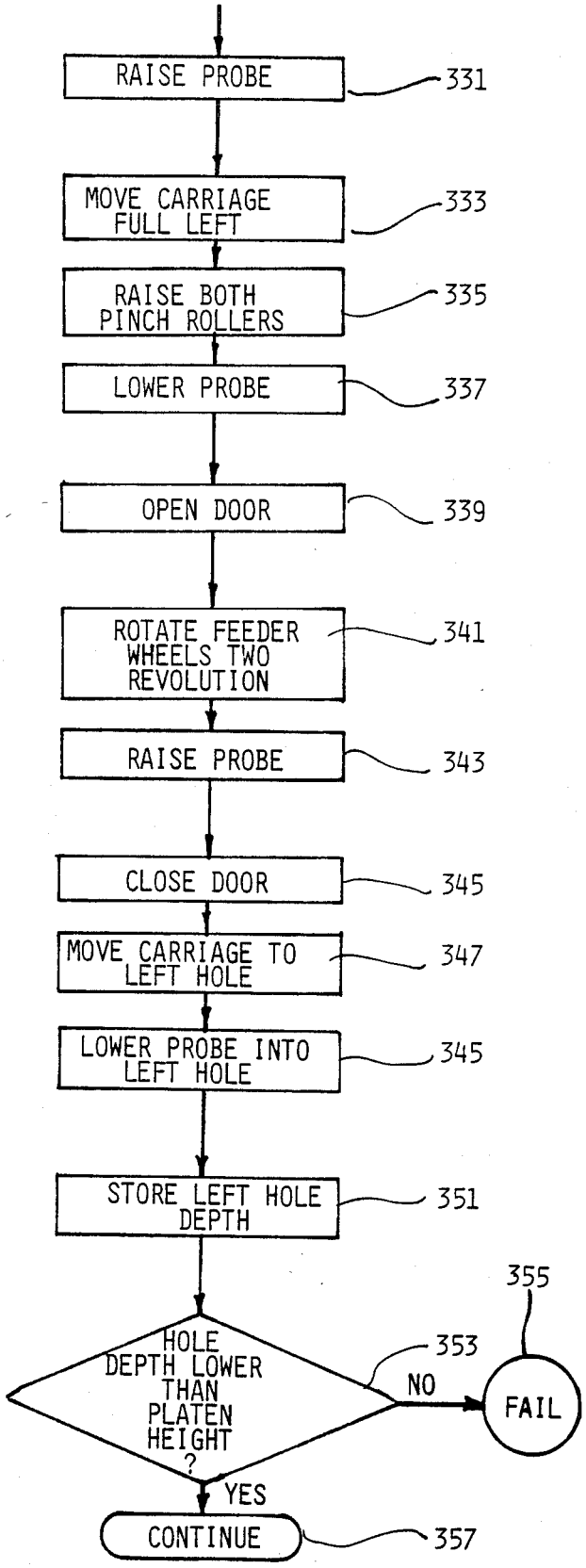

The next step 255 is to pre-feed a sheet of paper 33 from the paper tray so that the leading edge may be gripped by the grit wheels 81, 83. Step 255 is shown in greater detail in the flow chart of FIG. 12. In steps 331–339, the carriage 27 is moved to position 171 and probe 141 is lowered so that deflection door 19 is opened to allow motion thereby of a sheet of paper 33. In step 341, microprocessor 201 causes the pre-feed motor 211, monitored by shaft angle encoder 213, to rotate the shaft 69 exactly twice. This causes the sheet of paper 33 to follow the paper path shown in FIG. 2 so that the leading edge reaches the grit wheels 81, 83. In steps 343, 345, the probe 141 is raised causing the door 19 to close and to rest lightly upon the sheet of paper 33. In steps 347–353, the carriage 27 is moved to position 177 and the probe 141 is lowered to determine if the sheet of paper 33 is resident on the platen 21. If not, a failure of paper pre-feed is determined to have occurred and a failure routine must be performed.

Figure 13:
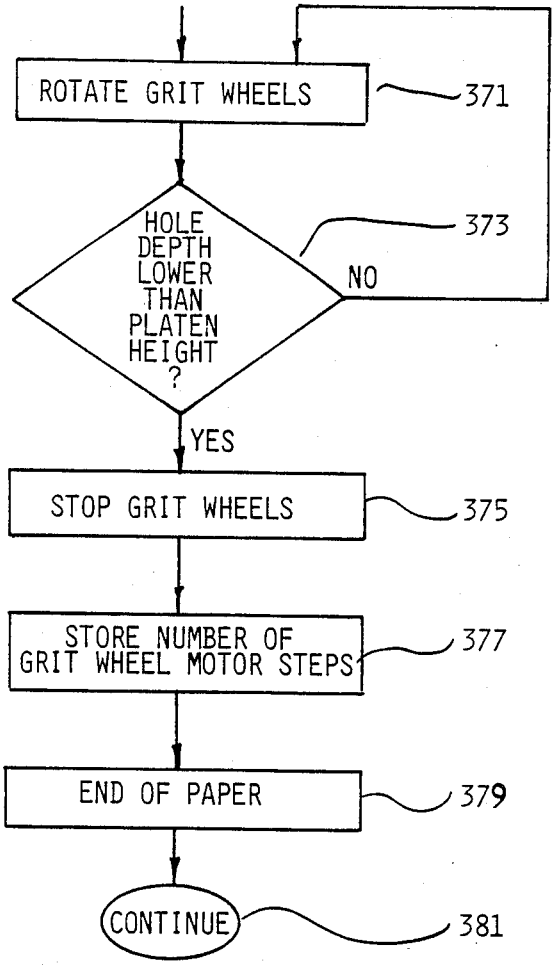

The next step 257 is performed if a successful pre-feed has occurred. FIG. 13 shows the feed paper step 257 in greater detail. In steps 371, 373, grit wheels 81, 83 (gripping the sheet of paper 33 against pinch rollers 73, 75) are controlled by microprocessor 201 and motor 217 to pull the sheet of paper completely onto the platen 21. The shaft angle encoder 219 monitors the total travel of the sheet of paper 33 to obtain a rough estimate of its length (possibly in error due to misalignment). When the probe 141 falls below the platen 21 level, indicating that the trailing edge of paper 33 has passed, microprocessor 201 causes the motor 217 to stop rotation of the grit wheels 81, 83. The total travel monitored by encoder 219 is stored in RAM 207 for future reference.

Figure 14:
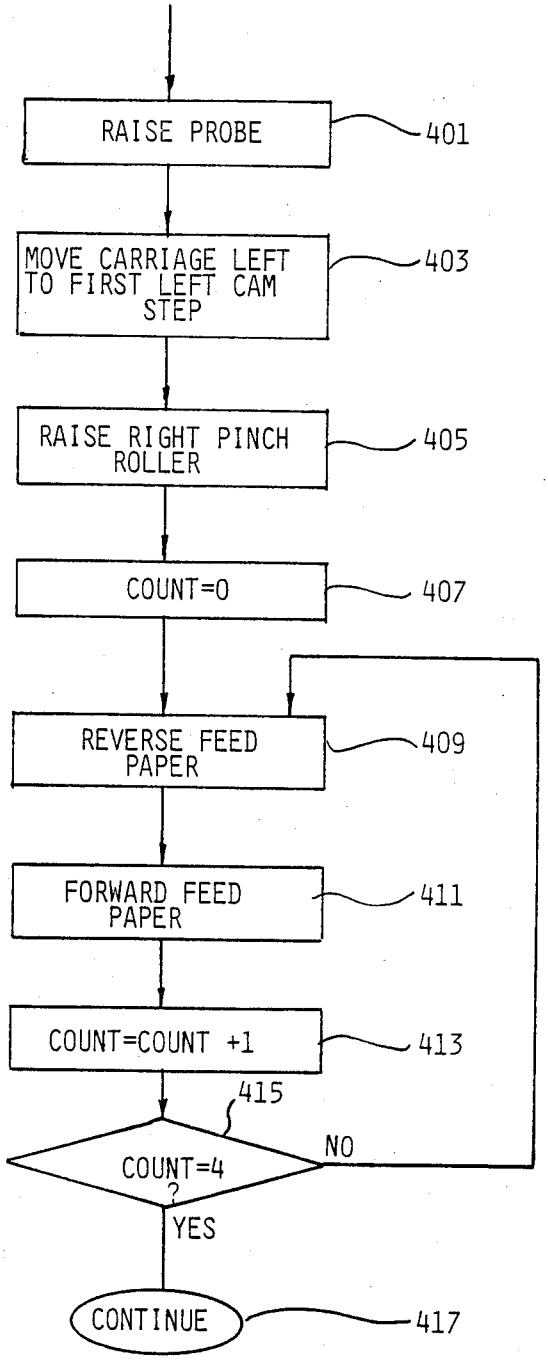

In step 259, the sheet of paper 33 is aligned so that high accuracy plotting may take place. FIG. 14 shows the alignment step 259 in greater detail. At this point, the sheet of paper 33 is beneath the carriage 27 and beyond the probe 141 which is still lowered within hole 127. In steps 401–405, the carriage 27 is moved to position 175 so that pin 143 engages the first step of cam 77 and the right pinch roller 75 is raised above the right grit wheel 83. Thus, the sheet of paper 33 is gripped only by the force of pinch roller 73 against grit wheel 81. The sheet of paper 33 is then, in steps 407–415, fed back and forth a number of times. Investigation has indicated that a total of four passes creates accurate alignment with a minimum of delay. Microprocessor 201 monitors the travel of paper 33 using encoder 219 and the previously measured length stored in RAM 207 to ensure that contact with grit wheel 81 is not inadvertently lost. The rotational force around grit wheel 81 causes the sheet of paper 33 to align against edge 37 so that the leading edge of paper 33 is parallel to the Y-axis travel of pen 25. Thus, highly accurate alignment of paper 33 is achieved and highly accurate and highly repeatable plotting may be performed. It is important that the speed and the acceleration of the back and forth travel of the paper 33 not be so high as to buckle or damage the paper 33. In addition, the coefficient of friction between the paper 33 and the various surfaces of plotter 1 must not be so high as to cause buckling of the paper 33 against the perpendicular edge 37 as the paper 33 is moved back and forth.

Figure 15:
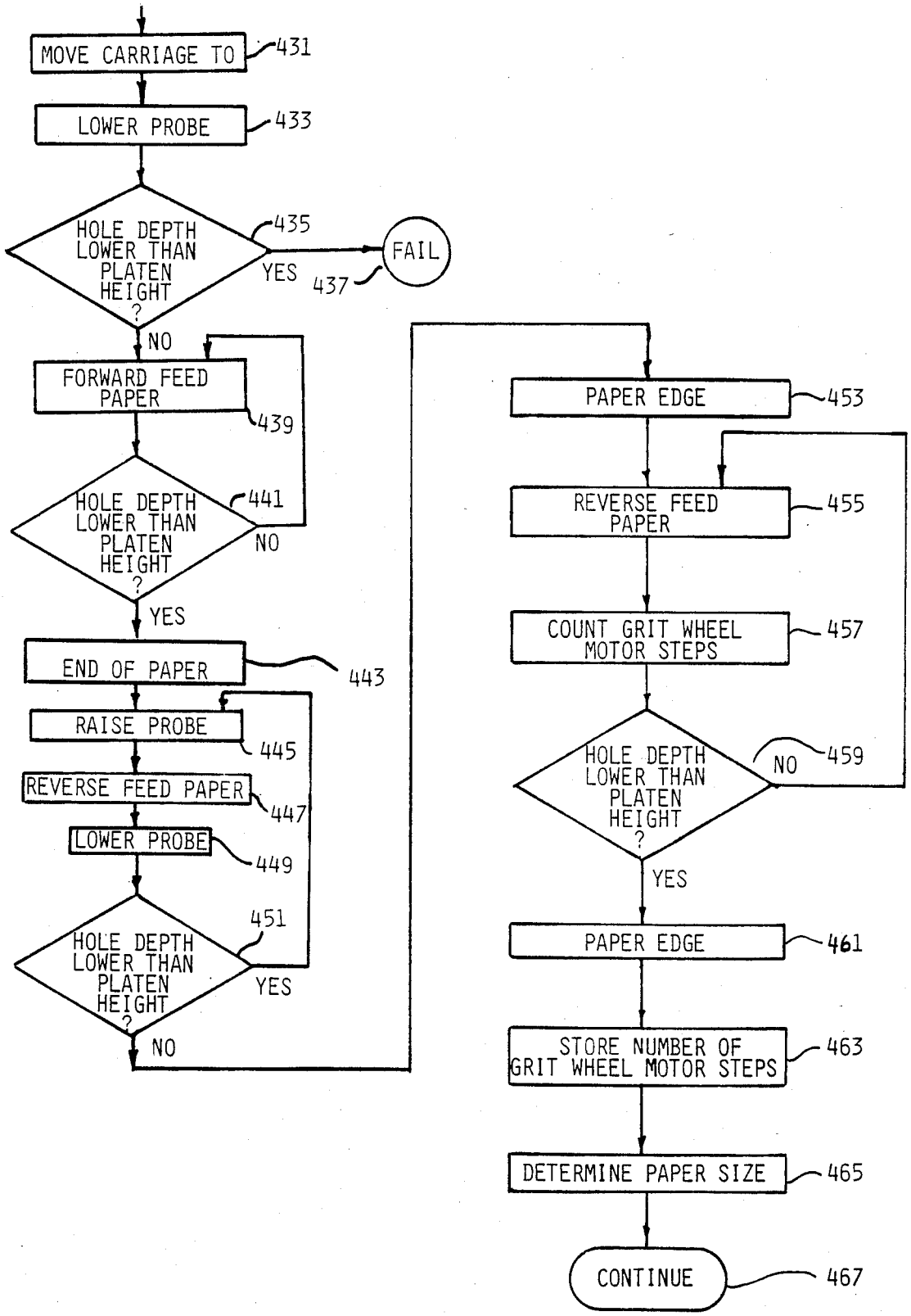

In step 261, the length of the sheet of paper 33 is determined. FIG. 15 shows the step 261 in greater detail. In steps 431–437, the carriage 27 is moved to position 177 and a determination of the presence of the paper 33 on the platen 21 is made. If the paper 33 is not detected, a failure routine must be implemented since the paper 33 has inadvertently been ejected beyond the grit wheel 81 and paper drive is no longer possible. In steps 439–443, the paper 33 is fed forward until the trailing edge is detected by probe 141. In steps 445–453, the probe 141 is placed just on the trailing edge of the paper 33. Then, in steps 455–461, the paper 33 is reverse fed by grit wheels 81, 83 until the leading edge is detected by probe 141. In step 463, the count of encoder 219 is stored in RAM 207 and in step 365, microprocessor 201 may determine the length of the paper 33 therefrom for future use.

Figure 16:
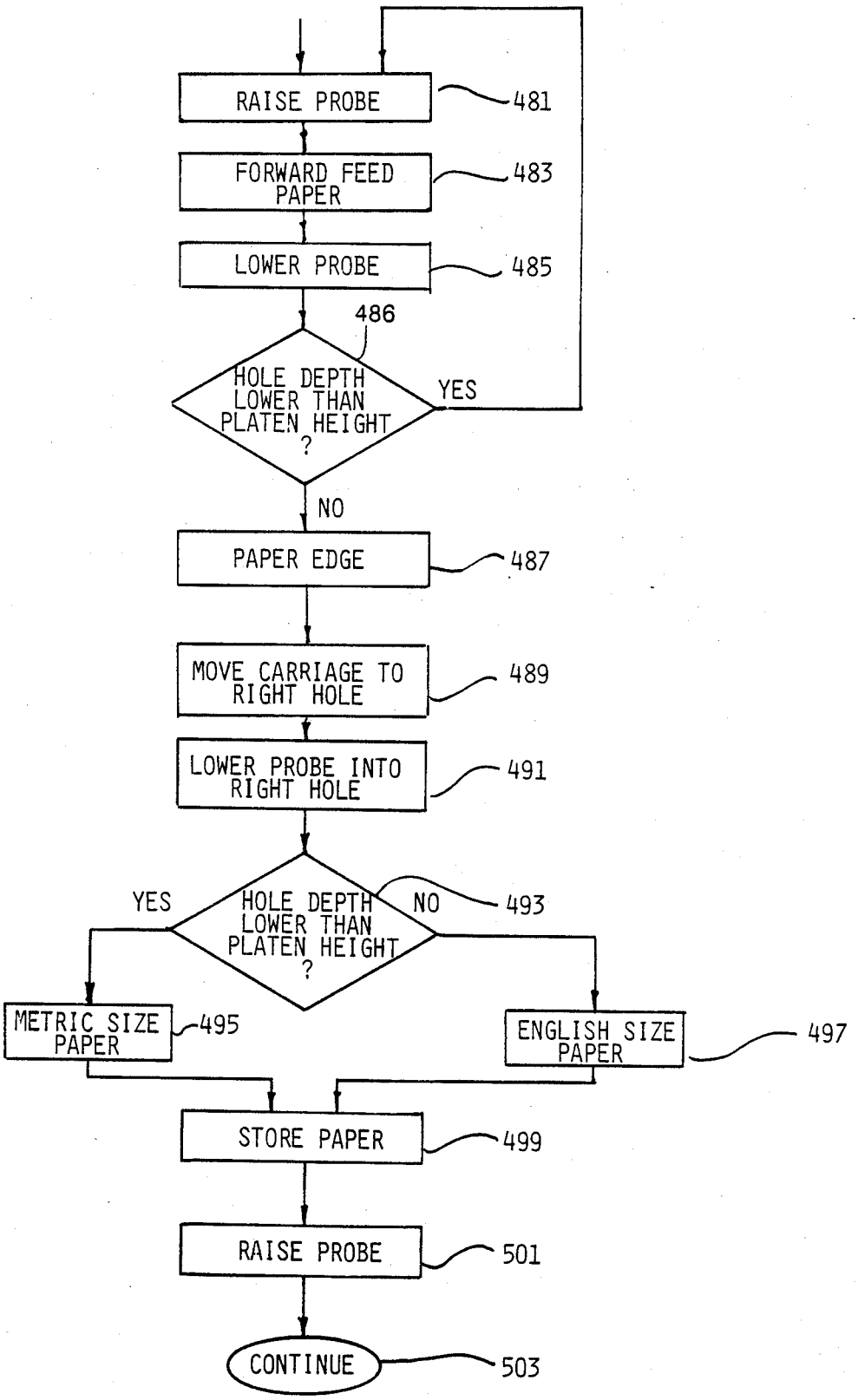

In step 263, the width of the paper 33 is determined for future reference. FIG. 16 shows the steps of step 263 in greater detail. In steps 481–487, the probe 141 is lowered just onto the leading edge of the paper 33. In steps 489–493, the carriage 27 is then moved to position 183 and a determination of the presence of the right edge of the paper 33 is made. If the right hole 129 is made a correct distance from the edge 37, then presence or non-presence of the right edge of the paper 33 indicates English or metric sizing of the paper 33 as depicted in steps 495 and 497. Alternatively, right hole 129 may be fabricated as a slot and probe 141 may be slid from left to right across the paper 33 until it falls off of the paper 33 into the slotted hole 129 to indicate the right edge. Encoder 219 may be used to monitor the distance travelled from a known point such as the left hole 127 to the right edge and the distance from the edge 37 to the known point may be stored in ROM 203 so that microprocessor 201 may compute the exact width of the paper 33 if desired. In step 499, the size of the paper 3 may now be stored in RAM 207 and, in step 501, the probe 141 is raised.

In step 265, the pen 25 is moved to the top of the paper 33. This may be easily performed since the positions of the right and leading edges of the paper 33 are known. In step 267, the desired plotting on the paper 33 is performed in any of a number of well-known ways as is typified, e.g., by the procedures used by the Hewlett-Packard Co. model 7580B plotter.

Figure 17:
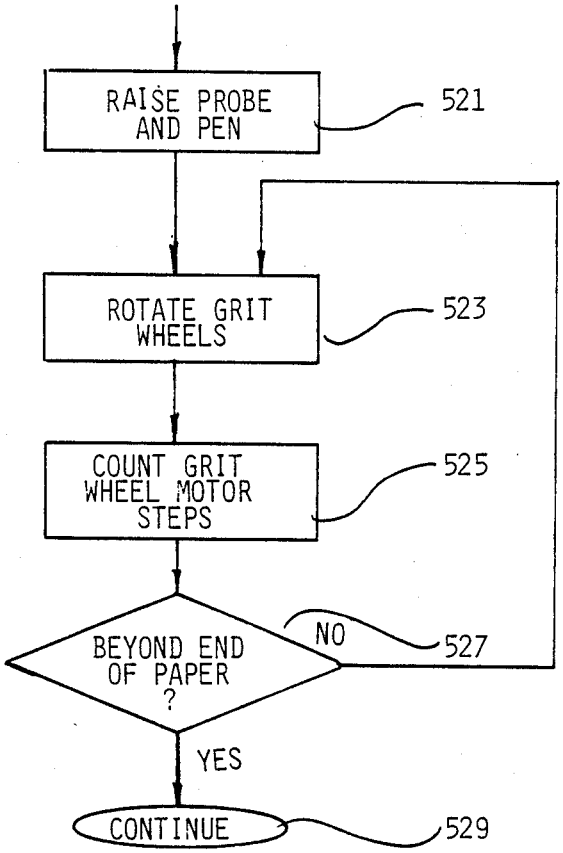

In step 269, the sheet of paper 33 may be ejected from the plotter 1 into the receiving tray 7 after plotting has been completed. FIG. 17 shows the step 269 in greater detail. In step 521, carriage 27 is raised to ensure that probe 141 and pen 25 do not contact the paper 33. In steps 523–527, the grit wheels 81, 83 are rotated a sufficient number of times to ensure that the paper 33 is fully ejected from the grit wheels 81, 83 and that a sufficient acceleration is imparted thereto to ensure that the paper 33 enters the tray 7.

Finally, another pre-feed step 255 may be performed for the next plot if so desired.

We claim:

1. A plotter for writing on a sheet of recording medium, comprising:

a surface for supporting the sheet in an X-Y plane;

carriage means, above the surface and movable in the Y-axis, for carrying a pen;

an alignment edge, parallel to the X-axis and located at an edge of the surface for contacting an edge of the sheet;

first drive means, located within the surface and in proximity to the alignment edge, for selectably gripping the sheet and imparting to the sheet a single force substantially parallel to the X-axis and thereby urging the sheet along the X-axis in a forward or reverse direction;

second drive means, located within the surface and distant from the alignment edge, for selectably gripping the sheet in conjunction with the first drive means and imparting to the sheet a single force substantially parallel to the X-axis and thereby urging the sheet along the X-axis in a forward or reverse direction; and lifting means, coupled to the first and second drive means, for causing the first drive means to grip the sheet either alone or in conjunction with the second drive means;

such that the sheet moves substantially parallel to the X-axis when both the first and second drive means grip and urge the sheet and such that the sheet moves substantially parallel to the X-axis and also tends to rotate about the first drive means and to align against the alignment edge when the first drive means grips and urges the sheet and the second drive means is disengaged from the sheet.

2. A plotter for writing on a sheet of recording medium, comprising:

a surface for supporting the sheet in an X-Y plane;

carriage means, above the surface and movable in the Y-axis, for carrying a pen;

an alignment edge, parallel to the X-axis and located at an edge of the surface for contacting an edge of the sheet;

first drive means, located within the surface and in proximity to the alignment edge, for selectably gripping the sheet and urging the sheet along the X-axis in a forward or reverse direction;

second drive means, located within the surface and distant from the alignment edge, for selectably gripping the sheet and urging the sheet along the X-axis in a forward or reverse direction;

lifting means, coupled to the first and second drive means, for causing the first drive means to grip the sheet either alone or in conjunction with the second drive means;

detector means, attached to the surface, for detecting a leading or a trailing edge of the sheet; and control means, coupled to the detector means, the lifting means and the first and second drive means, for causing the first drive means to grip the sheet alone and to urge the sheet along the X-axis in alternating forward and reverse directions such that the sheet pivots about the first drive means and the sheet edge is brought into alignment with the alignment edge.

3. A plotter as in claim 2, wherein the first and second drive means each comprise a grit wheel and a pinch wheel.

4. A method for aligning a sheet of recording medium against an X-axis alignment edge, comprising the steps of:

feeding a leading edge of the sheet into first and second drivers, the first driver being proximate the alignment edge and the second driver being distant from the alignment edge;

gripping the sheet with both the first driver and the second driver;

urging the sheet in a forward X-direction with both drivers;

detecting a trailing edge of the sheet;

stopping the forward X-direction motion of the sheet;

releasing the sheet from the second driver; urging the sheet in a reverse X-direction with the first driver;

stopping the reverse X-direction motion before the sheet travels beyond the first driver;

urging the sheet in the forward X-direction with the first driver; and stopping the forward X-direction motion before the sheet travels beyond the first driver;

whereby rotational forces about the first driver cause the sheet to align against the alignment edge.

5. A method as in claim 4, wherein the last four steps of urging, stopping, urging and stopping are repeated in sequence a predetermined number of times.

6. A method as in claim 5, further comprising:

returning the sheet to a predetermined starting position; and gripping the sheet with both the first and second drivers.

* * * * *